US008360791B2

(12) United States Patent
Shin

(10) Patent No.: US 8,360,791 B2
(45) Date of Patent: Jan. 29, 2013

(54) SAFE ELECTRICAL OUTLET

(76) Inventor: Hun-Soo Shin, Seoul (KR)

( * ) Notice: Subject to any disclaimer, the term of this patent is extended or adjusted under 35 U.S.C. 154(b) by 24 days.

(21) Appl. No.: 13/140,890

(22) PCT Filed: Jan. 2, 2009

(86) PCT No.: PCT/KR2009/000009
§ 371 (c)(1),
(2), (4) Date: Jun. 20, 2011

(87) PCT Pub. No.: WO2010/076906
PCT Pub. Date: Jul. 8, 2010

(65) Prior Publication Data
US 2011/0256745 A1 Oct. 20, 2011

(51) Int. Cl.
*H01R 13/44* (2006.01)

(52) U.S. Cl. ..... 439/137

(58) Field of Classification Search ..... 439/136, 439/137
See application file for complete search history.

(56) References Cited

U.S. PATENT DOCUMENTS 5,281,156 A * 1/1994 Yi ..... 439/137

FOREIGN PATENT DOCUMENTS

| | | | |
|---|---|---|---|
| KR | 20-1996-0005021 | Y1 | 6/1995 |
| KR | 10-2002-0084149 | A | 11/2002 |
| KR | 20-0341326 | Y1 | 2/2004 |
| KR | 10-2004-0090059 | A | 10/2004 |
| KR | 10-2005-0013310 | A | 2/2005 |

OTHER PUBLICATIONS

International Search Report (PCT/KR2009/000009).

* cited by examiner

*Primary Examiner* — Tho D Ta
(74) *Attorney, Agent, or Firm* — Park & Associates IP Law, P.C.

(57) ABSTRACT

Provided is a safe electrical outlet, which includes a case having a top opening and an inner lower portion to which a connecting terminal is fixed, a lift plate coupled to an inner portion of the case and vertically moving and including at least one insertion hole in which a connecting pin of a plug for connecting to a power source is inserted, and a lift operation unit coupled to the inner portion of the case. When the connecting pin is inserted in the insertion hole to move the lift plate downward in the case, the connecting terminal contacts the connecting pin, and the lift operation unit fixes the lift plate. When the plug is pressed to a lower side of the case with the connecting terminal contacting the connecting pin, the lift plate is elastically moved upward to space the connecting pin apart from the connecting terminal.

13 Claims, 16 Drawing Sheets

SAFE ELECTRICAL OUTLET

REFERENCE TO RELATED APPLICATIONS

This is a national phase entry of pending International Patent Application PCT/KR2009/000009 filed on Jan. 2, 2009, the entire contents of which are incorporated herein by reference.

FIELD OF THE INVENTION

The present invention relates to a safe electrical outlet coupled to a plug to connect a power source to various electric/electronic appliances, and more particularly, to a safe electrical outlet that is coupled to and decoupled from a plug just by pressing the plug against the safe electrical outlet.

BACKGROUND OF THE INVENTION

In general, an outlet is coupled to a plug of an electric or electronic appliance to supply power to the electric or electronic appliance through the plug. Such outlets may be embedded in walls of various buildings, and may be integrated to form a portable power strip.

Typically, an outlet has insertion holes in its front surface to receive connecting pins of a plug. Connecting terminals, which are connected to a power source and contact the connecting pins to transmit current, are fixed to the inner portion of the outlet below the insertion holes. When the connecting pins of the plug are inserted through the insertion holes, the connecting pins physically contact the connecting terminals to transmit current.

However, in this case, the plug should be pushed to the outlet to couple the plug to the outlet, and the plug should be pulled out of the outlet to decouple the plug from the outlet. When the plug is removed from the outlet, the outlet may be broken due to excessive pulling force or unintended locking in the outlet.

Furthermore, since a foreign material such as a chop stick or a nail can be easily inserted into insertion holes of a typical outlet, children may be exposed to danger from electric shock, and dust or moisture may be introduced to cause an electric leak and a short circuit.

SUMMARY OF THE INVENTION

An object of the present invention is to provide a safe electrical outlet that is coupled to and decoupled from a plug just by pressing the plug against the safe electrical outlet.

Another object of the present invention is to provide a safe electrical outlet including a lift operation unit that can efficiently perform a vertical press operation.

Another object of the present invention is to provide a safe electrical outlet including a guide recess part that efficiently limits a vertical movement of a catching protrusion and that performs a stable locking and releasing operation.

Another object of the present invention is to provide a safe electrical outlet preventing introduction of various foreign substances through insertion holes.

Another object of the present invention is to provide a safe electrical outlet having a simple structure under which a rotation plate is efficiently rotated according a vertical movement of a lift plate.

Another object of the present invention is to provide a safe electrical outlet including a rotation plate that rotates to open insertion holes only when a lift plate moves downward.

Another object of the present invention is to provide a safe electrical outlet in which connecting pins of a plug inserted in insertion pins assist a rotation of a rotation plate in a rotation direction of the rotation plate.

Another object of the present invention is to provide a safe electrical outlet including a rotation plate inserted in extensions of insertion holes.

Another object of the present invention is to provide a safe electrical outlet that can be conveniently attached to a typical outlet without replacing the typical outlet.

Another object of the present invention is to provide a safe electrical outlet including insertion holes that are securely closed when a foreign material such as a chopstick is inserted into the safe electrical outlet, and an opening and closing operation is efficiently performed when a plug is inserted in the safe electrical outlet.

Another object of the present invention is to provide a safe electrical outlet including an opening and closing member that efficiently rotates under a simple structure and that securely closes insertion holes.

Another object of the present invention is to provide a safe electrical outlet having a minimum height and including an opening and closing member that efficiently performs an opening and closing operation.

The details of one or more embodiments are set forth in the accompanying drawings and the description below.

According to an aspect of the present invention, there is provided a safe electrical outlet including: a case having a top opening and an inner lower portion to which a connecting terminal is fixed; a lift plate coupled to an inner portion of the case and vertically moving and including at least one insertion hole in which a connecting pin of a plug for connecting to a power source is inserted; and a lift operation unit coupled to the inner portion of the case, wherein, when the connecting pin is inserted in the insertion hole to move the lift plate downward in the case, the connecting terminal contacts the connecting pin, and the lift operation unit fixes the lift plate, and when the plug is pressed to a lower side of the case with the connecting terminal contacting the connecting pin, the lift plate is elastically moved upward to space the connecting pin apart from the connecting terminal.

The lift operation unit may include: a central shaft vertically protruding downward from a central bottom of the lift plate; a lift guide coupled to the inner portion of the case and receiving a lower end of the central shaft such that the lower end vertically moves; a first elastic member inserted in the lift guide and elastically supporting the central shaft to an outside of the lift guide; a catching protrusion protruding into the lift guide; a pressing protrusion protruding to an opposite side to the catching protrusion and contacting the connecting pin and elastically moving the catching protrusion to the central shaft; and a guide recess part disposed in an outer surface of the central shaft, wherein the guide recess part is caught to the catching protrusion by a downward movement of the central shaft, and is released from the catching protrusion by another downward movement of the central shaft.

The guide recess part may include: an introduction recess guiding the catching protrusion to move to an upper side of the central shaft while the lift plate is moved downward by force pressing the plug; a first upper stopper limiting a relative upward movement of the catching protrusion; a lower stopper limiting a downward moving distance of the catching protrusion when the force pressing the plug is removed with the catching protrusion supported by the first upper stopper, and when the catching protrusion is relatively moved downward by the first elastic member; a second upper stopper limiting an upward moving distance of the catching protrusion when the catching protrusion is moved upward by force pressing the plug with the catching protrusion supported by the lower stopper; and a removal recess guiding the catching protrusion to be removed downward when the force pressing the plug is removed with the catching protrusion supported by the second upper stopper, and when the catching protrusion is relatively moved downward by the first elastic member.

The safe electrical outlet may further include: a rotation plate that is rotatably coupled to a lower portion of the lift plate to open and close the insertion hole; and a rotation plate operating part that rotates the rotation plate to open the insertion hole when the lift plate moves downward, and rotates the rotation plate to close the insertion hole when the lift plate moves upward.

The rotation plate operating part may include: guide protrusions protruding from both ends of the rotation plate; first guide recesses recessed from an inner surface of the case and extending in a vertical moving direction of the lift plate; second guide recesses laterally inclined from a lower portion of the first guide recesses; and a second elastic member coupled to a lower portion of the rotation plate and elastically supporting the rotation plate.

The safe electrical outlet may further include: vertical moving guides that protrude downward from both sides of the lift plate, closely contact the inner surface of the case, vertically move, and prevent a lateral rotation of the guide protrusion; and opening recesses that are disposed in inner surfaces of the vertical moving guides, and allow the guide protrusion to pass through the second guide recess to laterally rotate the rotation plate when the lift plate moves downward.

A slope protrusion may protrude from a top surface of the rotation plate and is inclined in a rotation direction of the rotation plate.

An insertion hole extension pipe may protrude downward from a bottom surface of the lift plate to form an extension of the insertion hole, sliding openings may be disposed at both sides of the insertion hole extension pipe, an opening portion having a diameter corresponding to that of the insertion hole may be disposed in the rotation plate, and connecting portions that are inserted in the sliding openings and vertically move may be disposed at both sides of the opening portion.

The safe electrical outlet may further include an auxiliary terminal pin that protrudes from a bottom surface of the case, may be inserted in a typical outlet, and may be connected to the connecting terminal.

According to another aspect of the present invention, there is provided a safe electrical outlet including: a case having a top opening and an inner lower portion to which a connecting terminal is fixed; a lift plate coupled to an inner portion of the case and vertically moving and including at least one insertion hole in which a connecting pin of a plug for connecting to a power source is inserted; an opening and closing member rotatably coupled to a lower portion of the lift plate and opening and closing the insertion hole; and a lift operation member, wherein, when the plug presses the lift plate downward, the lift operation member rotates the opening and closing member to open the insertion hole, and when the plug moves to an upper side of the lift plate to move the lift plate upward, the lift operation member rotates the opening and closing member to close the insertion hole.

The opening and closing member may include: a ring-shaped rotation ring rotatably coupled to an inner surface of the case and having a vertical through hole in a center thereof; and a closing portion passing through the center of the rotation ring, having both ends fixed to both sides of the rotation ring, and closing the insertion hole.

The lift operation member may include: a guide protrusion protruding from an outer surface of the lift plate; a guide recess recessed in the inner surface of the case, vertically extending, and receiving the guide protrusion; a pressing protrusion protruding from a bottom edge of the lift plate; a rotation slope ring protruding from a top surface of the rotation ring, contacting the pressing protrusion, and having a top slope to rotate the rotation ring according to a vertical movement of the pressing protrusion; and an elastic restoring member elastically rotating the opening and closing member to a closing position.

According to the present invention, since a plug is coupled to or decoupled from the safe electrical outlet just by pressing the plug to the safe electrical outlet, a plug can be coupled to or decoupled from the safe electrical outlet just with one hand. Thus, a plug can be more simply coupled to or decoupled from the safe electrical outlet, and even children or the disabled can conveniently couple or decouple a plug to or from the safe electrical outlet. Furthermore, since it is unnecessary to pull out a plug from the safe electrical outlet with excessive force, breakage of the safe electrical outlet can be prevented.

In addition, since the lift operation unit includes the central shaft, the lift guide, the first elastic member, the catching protrusion, the pressing protrusions, and the guide recess part, a vertical press movement performed by the lift operation unit is facilitated. Thus, the lift plate is prevented from laterally leaning while vertically moving, thereby preventing damage or trouble of the safe electrical outlet and facilitating coupling or decoupling of a plug and the safe electrical outlet.

In addition, since the guide recess part efficiently limits a vertical movement of the catching protrusion to stably perform a locking and releasing process, a vertical removal of the lift plate from the guide recess part can be prevented, and the guide recess part can be easily manufactured.

In addition, since the safe electrical outlet includes the rotation plate and the rotation plate operating part to prevent various foreign substances from being introduced to the insertion holes, a conductor such as a chopstick or a nail can be prevented from being inserted into the insertion holes, thereby preventing an electric shock. In addition, an electric leak and a short circuit due to introduction of a foreign substance such as dust or moisture can be prevented.

In addition, since the rotation plate operating part includes the guide protrusions, the first guide recesses, the second guide recesses, and the second elastic member under a simple structure, the rotation plate is efficiently rotated according to a vertical movement of the lift plate. Thus, the number of parts can be reduced, a process of manufacturing the rotation plate operating part is simplified, and a vertical movement and a lateral rotation of the rotation plate are smooth and efficient.

In addition, since the vertical moving guides and the opening recesses allow a rotation of the rotation plate only when the lift plate moves downward, the rotation plate rotates to open the insertion holes only when a plug is inserted to press the rotation plate. Thus, when a foreign material such as a chopstick or a nail is inserted into the insertion holes, a rotation of the rotation plate is prevented.

In addition, when connecting pins of a plug are inserted in the insertion holes to rotate the rotation plate, the slope protrusions disposed on the top surface of the rotation plate apply force to the rotation plate in a rotation direction of the rotation plate. Thus, pressure applied to the rotation plate 40 can be dispersed, thereby preventing breakage of the rotation plate.

In addition, since the insertion hole extension pipe, the sliding openings, the opening portions, and the connecting portions are provided, the rotation plate is inserted in the insertion hole extension pipe to more securely close the insertion holes, thereby more effectively preventing introduction of a foreign substance.

In addition, since the safe electrical outlet includes the auxiliary terminal pins, the safe electrical outlet can be conveniently attached to a typical outlet, and thus, it is unnecessary to replace the typical outlet.

In addition, when a foreign material such as a chopstick is inserted into the safe electrical outlet, the insertion holes are securely closed. When a plug is inserted into the safe electrical outlet, the insertion holes are opened. Accordingly, unintended access to the safe electrical outlet by children is prevented, and children can be protected from an electric shock. In addition, an electric leak and a short circuit due to introduction of a foreign substance such as dust or moisture can be prevented.

In addition, since the opening and closing member includes the rotation ring and the closing portion under a simple structure for securely closing the insertion holes, the number of parts constituting the safe electrical outlet can be reduced, a process of manufacturing the safe electrical outlet is simplified.

In addition, since the lift operation member includes the guide protrusions, the guide recess parts, the pressing protrusions, the rotation slope ring, and the elastic restoring members, the entire height of the safe electrical outlet is minimized, and the opening and closing member is efficiently rotated to perform an opening and closing operation. Accordingly, a space taken by the safe electrical outlet can be reduced.

BRIEF DESCRIPTION OF THE DRAWINGS

The above objects and other advantages of the present invention will become more apparent by describing in detail preferred embodiments thereof with reference to the attached drawings in which.

DETAILED DESCRIPTION OF THE INVENTION

Embodiments of the present invention will be described below in more detail with reference to the accompanying drawings.

Figure 1:
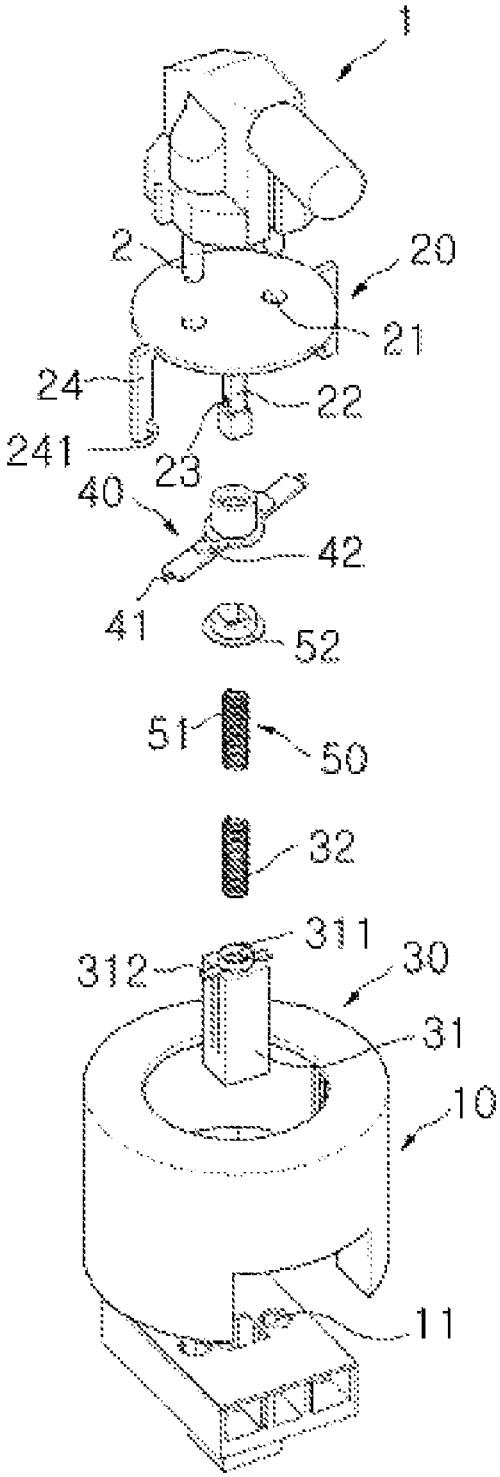
FIGS. 1 and 2 are exploded perspective views illustrating a safe electrical outlet according to a first embodiment of the present invention.
Figure 2:
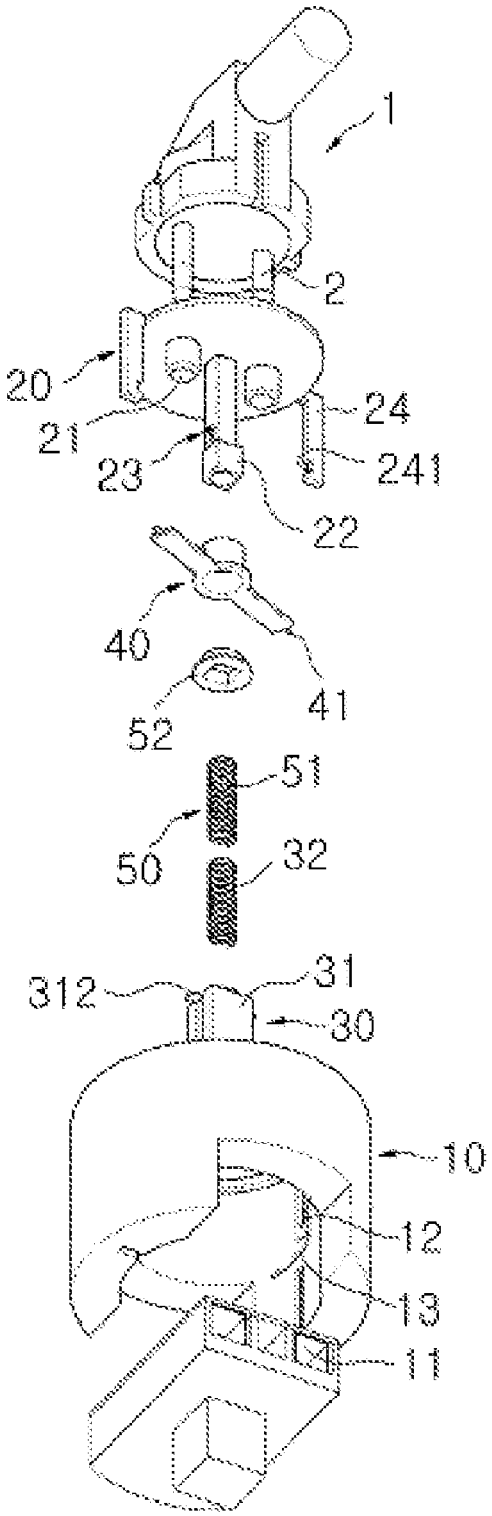
Figure 3:
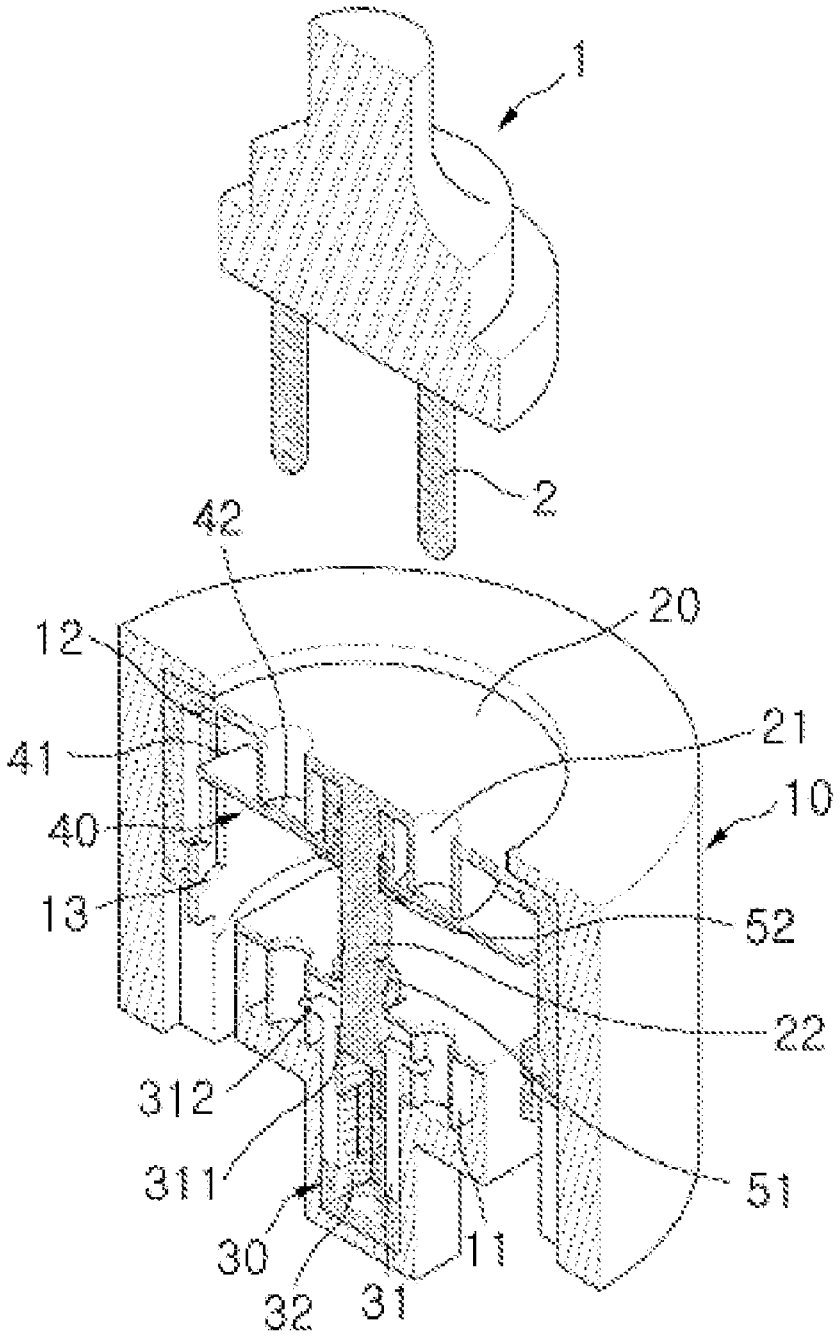
FIGS. 3 to 7 are cut-away perspective views illustrating a process in which a plug is coupled to the safe electrical outlet according to the first embodiment.
Figure 4:
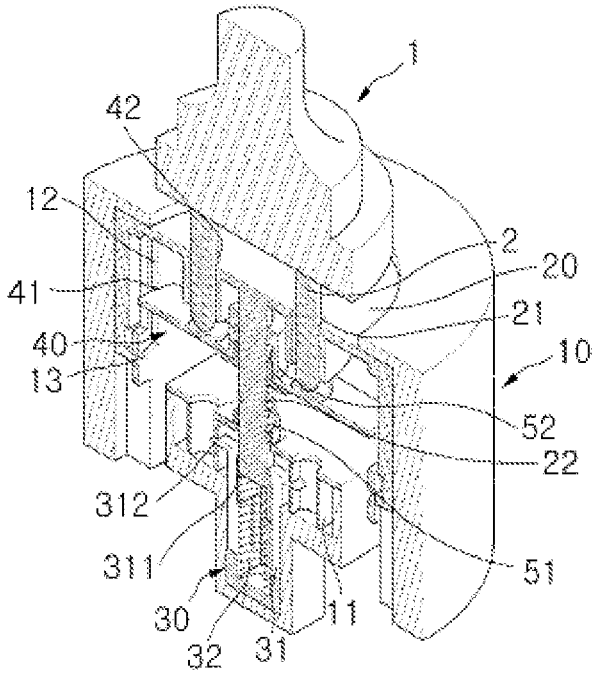
Figure 5:
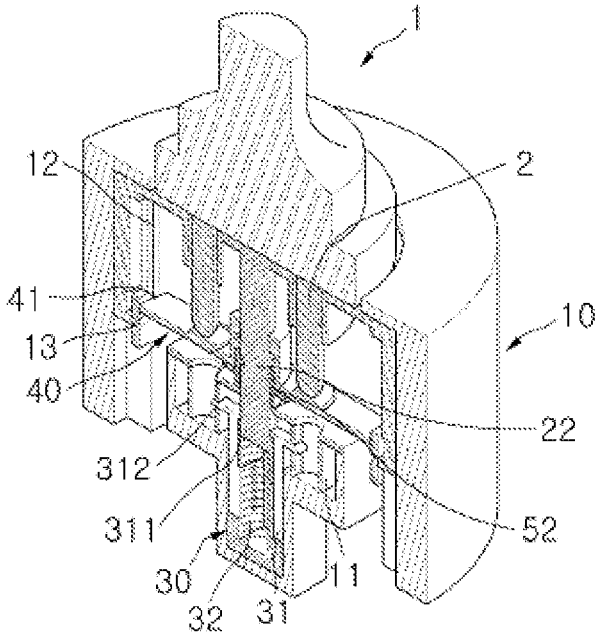
Figure 6:
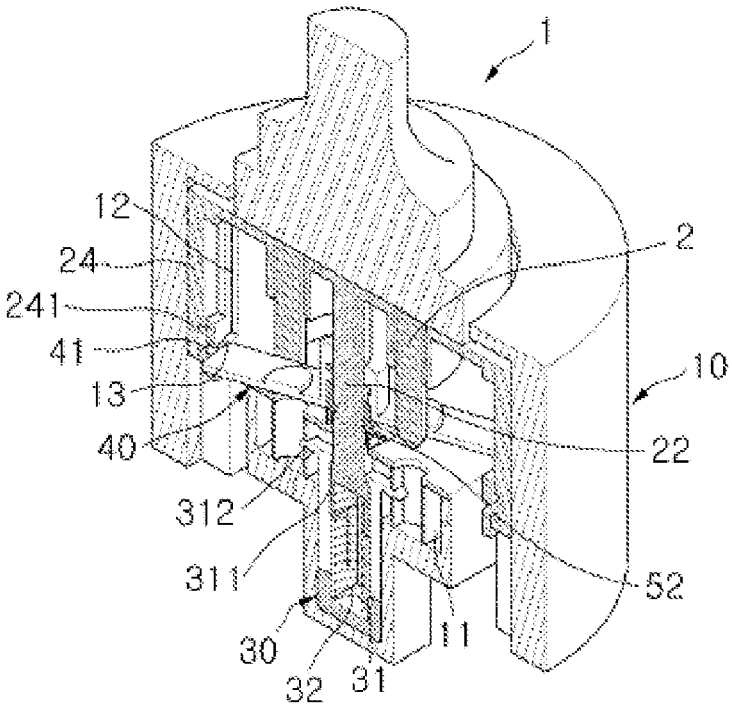
Figure 7:
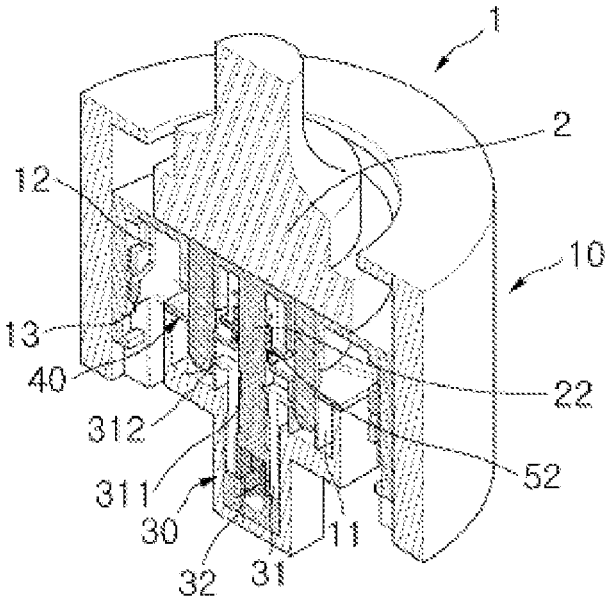
Figure 8:
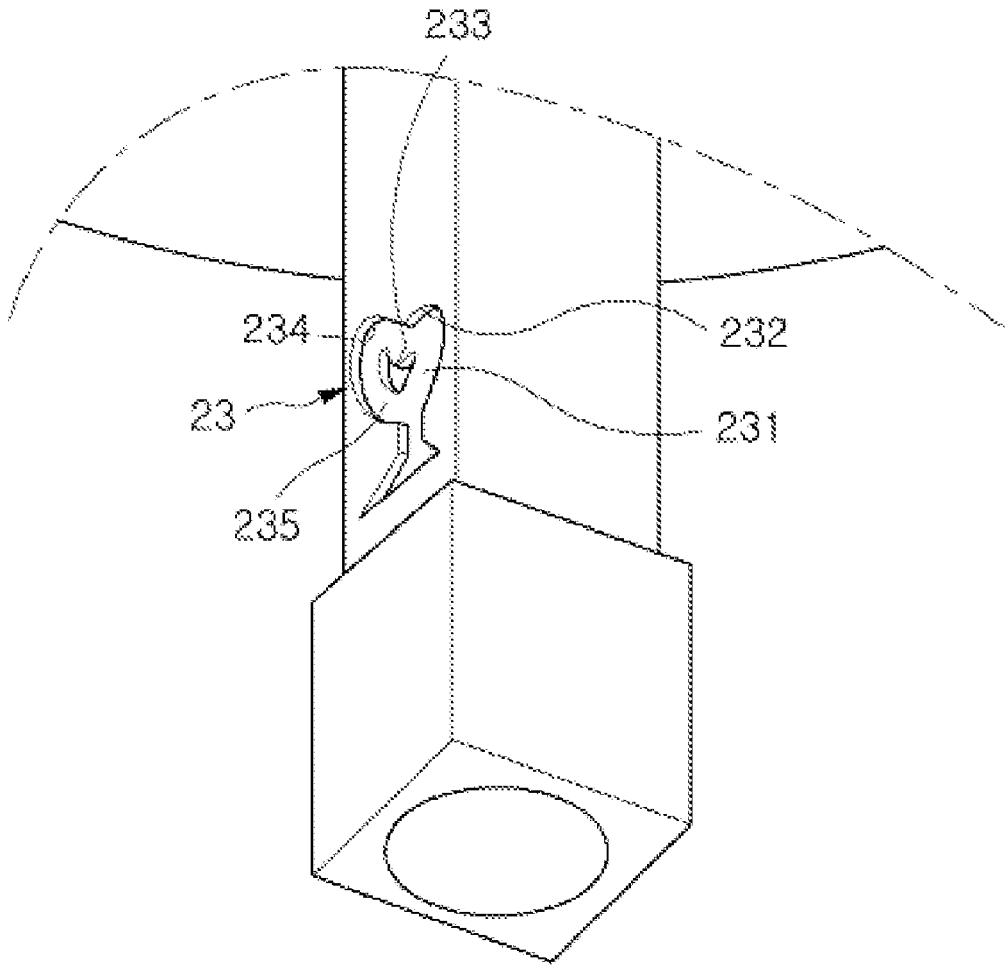
FIG. 8 is a perspective view illustrating a guide recess part according to an embodiment of the present invention.
Figure 9:
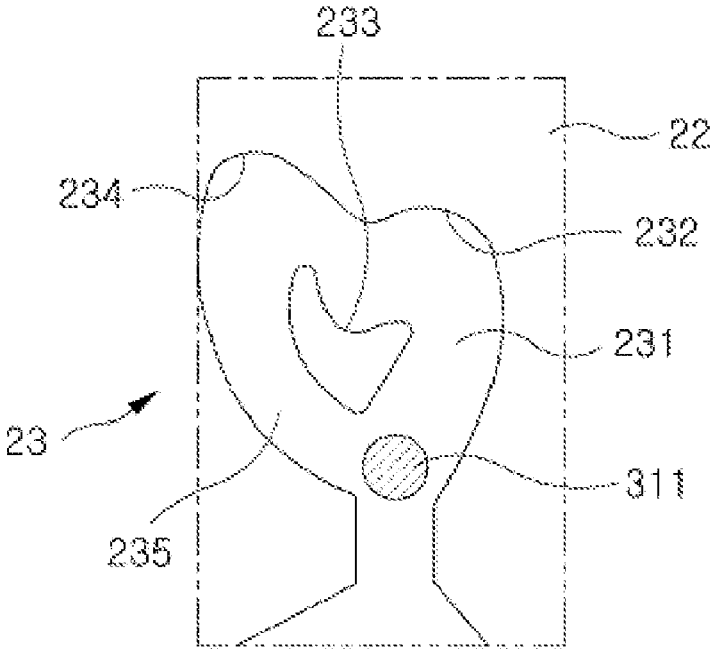
FIGS. 9 to 13 are front views illustrating processes in which a principal part of the guide recess part of FIG. 8 is caught and released.
Figure 10:
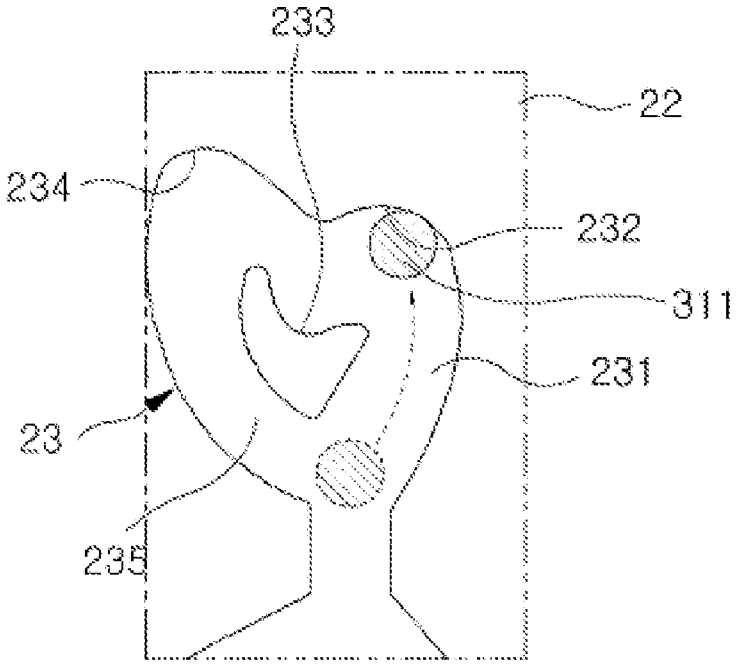
Figure 11:
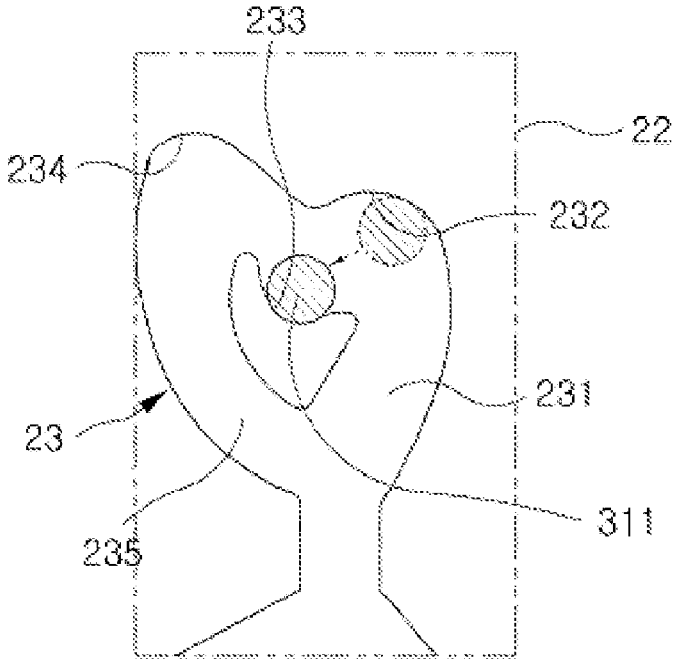
Figure 12:
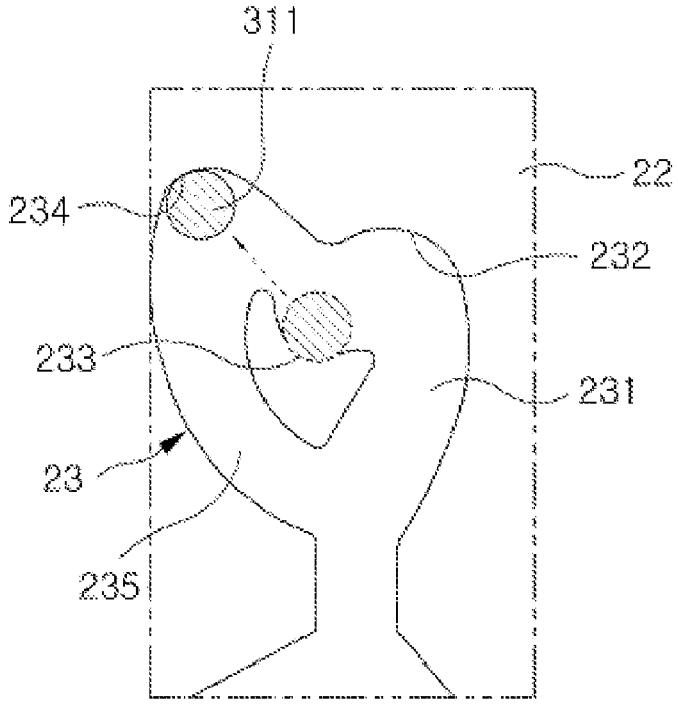
Figure 13:
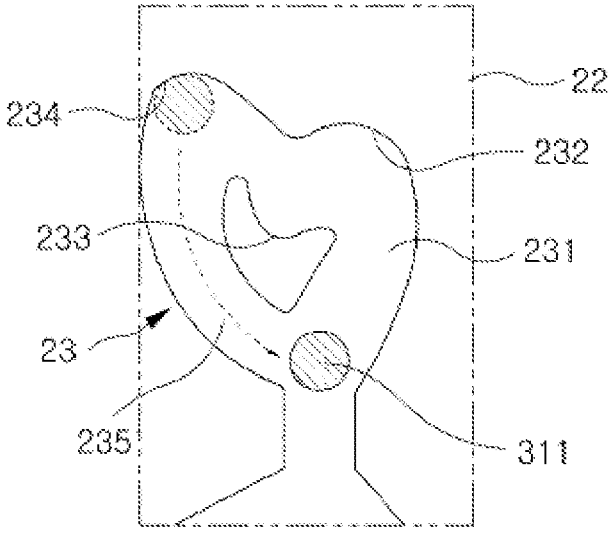

FIGS. 1 and 2 are exploded perspective views illustrating a safe electrical outlet according to a first embodiment of the present invention. FIGS. 3 to 7 are cut-away perspective views illustrating a process in which a plug 1 is coupled to the safe electrical outlet. FIG. 8 is a perspective view illustrating a guide recess part 23 according to an embodiment of the present invention. FIGS. 9 to 13 are front views illustrating processes in which a principal part of the guide recess part 23 is caught and released.

Referring to FIGS. 1 and 2, the plug 1 connecting a power source to electric/electronic appliances is coupled to or decoupled from the safe electrical outlet just by pressing the plug 1 against the safe electrical outlet. The safe electrical outlet includes: a case 10 including connecting terminals 11 therein to contact connecting pins 2 of the plug 1 and connect to a power source; a lift plate 20 vertically moving over the case 10; and a lift operation unit 30 configured such that the connecting pins 2 of the plug 1 are coupled to or decoupled from the connecting terminals 11 of the safe electrical outlet by pressing the lift plate 20 to the safe electrical outlet.

The case 10 forms a space in which the lift plate 20 to be described later vertically moves, and covers the connecting terminals 11 and the connecting pins 2 of the plug 1 through which electric current flows, to prevent an electric shock. The case 10 is formed of a typical electrically insulated synthetic resin, and has a top opening to receive and couple to the lift plate 20, so that the plug 1 is closely coupled to the lift plate 20.

An inner bottom of the case 10 is connected to a power source, and fixes at least one of the connecting terminals 11 in which the connecting pins 2 of the plug 1 are inserted. Thus, the connecting terminals 11 physically contact the connecting pins 2 to discharge current to the connecting pins 2.

The lift plate 20 closes the top opening of the case 10, and vertically moves such that the connecting pins 2 are coupled to or decoupled from the connecting terminals 11 fixed in the case 10. The lift plate 20 is constituted by an electrically insulated plate, and includes one or more insertion holes 21 that vertically extend. Accordingly, the connecting pins 2 of the plug 1 are inserted in the case 10 through the insertion holes 21, and vertically move along the inner surface of the case 10.

When the plug 1 is repeatedly pressed into the case 10 with the connecting pins 2 inserted in the insertion holes 21, the lift operation unit 30 connects or disconnects the connecting pins 2 to or from the connecting terminals 11. The lift operation unit 30 includes: a central shaft 22 vertically protruding from a central bottom of the lift plate 20; a lift guide 31 coupled to the inner side of the case 10 and receiving the lower end of the central shaft 22 to vertically move the lower end; a first elastic member 32 inserted in the lift guide 31 and elastically supporting the central shaft 22 to the outside of the lift guide 31; a catching protrusion 311 protruding to the inside of the lift guide 31; pressing protrusions 312 protruding to opposite sides to the catching protrusion 311 and contacting the connecting pins 2; and the guide recess part 23 caught to and released from the catching protrusion 311 when being moved downward by repeated downward moving of the central shaft 22.

The central shaft 22 protrudes from the central bottom of the lift plate 20 to guide a vertical movement of the lift plate 20 and support the lift plate 20. The lift guide 31 having a recess is disposed at the inner central portion of the case 10 to receive the lower end of the central shaft 22 and allow a vertical movement of the lower end of the central shaft 22. Thus, when the lift plate 20 vertically moves, the lower end of the central shaft 22 vertically moves along the inner surface of the lift guide 31 to prevent dislocation of the lift plate 20.

The first elastic member 32, supporting the lift plate 20 to the outside of the case 10, is constituted by a typical coil spring, and is inserted in the lift guide 31, and both ends thereof support the inner bottom of the lift guide 31 and the bottom of the central shaft 22, respectively. Accordingly, the lift plate 20 can quickly and elastically move toward the outside of the case 10.

When the lift plate 20 moves downward, the connecting pins 2 contact the connecting terminals 11 fixed to the case 10. At this point, the catching protrusion 311 fixes the lift plate 20. The catching protrusion 311 protrudes from the upper end of the lift guide 31 to the central shaft 22, and elastically moves to the central shaft 22. When the lift plate 20 moves downward, the catching protrusion 311 is coupled to the guide recess part 23 to be described later, to catch or release the lift plate 20.

After the connecting pins 2 are inserted in the insertion holes 21, when the lift plate 20 moves downward, the pressing protrusions 312 contact the connecting pins 2. At this point, the catching protrusion 311 moves to the central shaft 22. The pressing protrusions 312 protrude to the opposite sides to the catching protrusion 311.

The guide recess part 23 is recessed in the outer surface of the central shaft 22, and forms a protrusion. When the central shaft 22 moves downward, the catching protrusion 311 catches and fixes the guide recess part 23. When the central shaft 22 further moves downward, the guide recess part 23 is released from the catching protrusion 311, so that the lift plate 20 is moved upward by the elasticity of the first elastic member 32.

Referring to FIG. 8, the guide recess part 23 may include an introduction recess 231, a first upper stopper 232, a lower stopper 233, a second upper stopper 234, and a removal recess 235. The introduction recess 231 is disposed in the outer surface of the central shaft 22, and guides insertion of the catching protrusion 311 into the guide recess part 23 while the lift plate 20 moves downward. The first upper stopper 232 limits a relative upward movement of the catching protrusion 311 with respect to the central shaft 22. When pressing force is removed from the plug 1, the lift plate 20 is moved upward by the elasticity of the first elastic member 32, and the catching protrusion 311 catches and fixes the lower stopper 233. In this state, when the plug 1 is pressed, the second upper stopper 234 limits a relative upward movement of the catching protrusion 311. When pressing force is removed from the plug 1, the removal recess 235 guides a removal of the catching protrusion 311 from the guide recess part 23, by using the elasticity of the first elastic member 32.

Accordingly, referring to FIGS. 3 to 7, and 9 to 13, when the plug 1 is coupled to the safe electrical outlet, the connecting pins 2 are inserted into the insertion holes 21. Then, when the plug 1 is pressed to the lift plate 20, the lift plate 20 is moved downward. At this point, the lower end of the central shaft 22 disposed in the lift guide 31 slides downward.

After that, when the connecting pins 2 contact the pressing protrusions 312, the catching protrusion 311 disposed at the opposite side to the pressing protrusions 312 closely contacts the central shaft 22. When the lift plate 20 continually moves downward, the catching protrusion 311 is inserted into the guide recess part 23 along the introduction recess 231 disposed in the outer surface of the central shaft 22. Finally, when the catching protrusion 311 contacts the first upper stopper 232, the downward moving of the lift plate 20 is stopped, and the connecting pins 2 contact the connecting terminals 11.

In this state, when pressing force is removed from the plug 1, the central shaft 22 is moved upward by the elasticity of the first elastic member 32. At this point, the catching protrusion 311 catches and fixes the lower stopper 233 to limit the upward moving of the lift plate 20. Accordingly, contact between the connecting pins 2 and the connecting terminals 11 is maintained, and the power source is connected to the connecting pins 2.

When the plug 1 coupled to the safe electrical outlet is pressed again to the case 10 to remove the plug 1 from the safe electrical outlet, the lift plate 20 is moved downward, and the catching protrusion 311 is relatively moved upward with respect to the central shaft 22. At this point, the catching protrusion 311 catches the second upper stopper 234, the downward moving of the lift plate 20 is stopped.

In this state, when pressing force is removed from the plug 1, the catching protrusion 311 is completely removed from the guide recess part 23 along the removal recess 235. Then, when the lift plate 20 is moved upward by the elasticity of the first elastic member 32, the connecting pins 2 are completely disconnected from the connecting terminals 11 and the power source. Thus, the plug 1 is connected to and disconnected from the safe electrical outlet just by repeatedly pressing the plug 1 to the safe electrical outlet.

Only when the connecting pins 2 press the pressing protrusions 312, the catching protrusion 311 is inserted into the guide recess part 23 recessed in the central shaft 22. When the connecting pins 2 do not press the pressing protrusions 312, the catching protrusion 311 is not inserted in the guide recess part 23. Accordingly, when only the lift plate 20 is pressed to the case 10 without inserting the plug 1, the lift plate 20 may be pushed toward the outside of the case 10 by the elasticity of the first elastic member 32.

Thus, when the lift plate 20 is pushed by other items except for the plug 1, downward moving and fixing of the lift plate 20 are prevented, thereby improving safety of the safe electrical outlet. In addition, even wherein the plug 1 is forcibly pulled out of the safe electrical outlet, the lift plate 20 quickly returns to its original position, and normal contact between the connecting pins 2 and the connecting terminals 11 is maintained to prevent a spark between the connecting pins 2 and the connecting terminals 11.

A rotation plate 40 is rotatably coupled to the central bottom of the lift plate 20, and moves and rotates according to a vertical movement of the lift plate 20 to open and close the insertion holes 21 of the lift plate 20. A rotation plate operating part 50 is disposed in the case 10. When the plug 1 is inserted to move the lift plate 20 downward, the rotation plate operating part 50 rotates the rotation plate 40 to open the insertion holes 2. When the lift plate 20 is moved upward to remove the plug 1 from the safe electrical outlet, the rotation plate operating part 50 closes the insertion holes 21.

The rotation plate 40 has a plate shape with a length corresponding to the diameter of the lift plate 20, and has a width greater than the diameter of the insertion holes 21. The rotation plate 40 includes a rotation shaft in the central portion thereof, and thus, is rotatably coupled to the bottom surface of the lift plate 20. Accordingly, the rotation plate 40 rotates on the lift plate 20 to open or close the insertion holes 21, so that a conductor such as a chopstick can be prevented from being inserted into the insertion holes 21, thereby preventing an electric shock. In addition, an electric leak and a short circuit due to introduction of a foreign substance such as dust can be prevented.

The rotation plate operating part 50 rotates the rotation plate 40 according to a vertical movement of the lift plate 20, to open and close the insertion holes 21. The rotation plate operating part 50 includes: guide protrusions 41 protruding from both ends of the rotation plate 40; first guide recesses 12 recessed in the inner surface of the case 10 in the vertical moving direction of the lift plate 20; second guide recesses 13 obliquely extending from the lower portions of the first guide recesses 12; and a second elastic member 51 coupled to the lower portion of the rotation plate 40 to elastically support the rotation plate 40 to the upper portion of the case 10.

Accordingly, when the safe electrical outlet is assembled, the guide protrusions 41 are inserted in the first guide recesses 12 at the position where the rotation plate 40 closes the insertion holes 21. In this state, when the lift plate 20 moves downward, the guide protrusions 41 move downward along the first guide recesses 12 without rotation of the rotation plate 40, thereby maintaining the closing of the insertion holes 21.

After that, when the lift plate 20 is further moved downward, the guide protrusions 41 obliquely moves along the second guide recesses 13. Accordingly, the rotation plate 40 rotates to open the insertion holes 21, and the connecting pins 2 are coupled to the connecting terminals 11 through the rotation plate 40

When the plug 1 is removed from the safe electrical outlet to move the lift plate 20 upward, the guide protrusions 41 move upward along the second guide recesses 13 to close the insertion holes 21 again. At this point, since the upward moving of the rotation plate 40 is supported by the elasticity of the second elastic member 51 constituted by a typical coil spring, the rotation plate 40 is efficiently rotated.

After that, when the guide protrusions 41 are inserted into the first guide recesses 12, the rotation plate 40 completely closes the insertion holes 21 to prevent introduction of various foreign substances through the insertion holes 21.

The lift plate 20 includes vertical moving guides 24 at both sides thereof. The vertical moving guides 24 extend downward, and vertically move, closely contacting the inner surface of the case 10. The vertical moving guides 24 include opening recesses 241 in the inner surfaces thereof. When the guide protrusions 41 rotate, the guide protrusions 41 pass through the opening recesses 241.

Accordingly, when a foreign substance such as a chopstick or a nail presses the rotation plate 40 without moving the lift plate 20 downward, the guide protrusions 41 moving from the first guide recesses 12 to the second guide recesses 13 are caught to the vertical moving guides 24 and are prevented from rotating, and thus, the insertion holes 21 are prevented from being opened.

When the connecting pins 2 of the plug 1 are inserted into the insertion holes 21, the plug 1 entirely presses the lift plate 20. At this point, the vertical moving guides 24 move downward, and the opening recesses 241 open the second guide recesses 13. Accordingly, the guide protrusions 41 are allowed to laterally rotate through the second guide recesses 13. Thus, unintended access to the safe electrical outlet by children is prevented, and children can be protected from an electric shock.

The rotation plate 40 includes slope protrusions 42 on the top surface thereof. The slope protrusions 42 have a top slope directed in the rotation direction of the rotation plate 40. Thus, when the guide protrusions 41 move along the second guide recesses 13, the connecting pins 2 laterally push the rotation plate 40 to assist rotation of the rotation plate 40 and disperse pressure applied to the rotation plate 40, thereby preventing breakage of the rotation plate 40.

The slope protrusions 42 may have a diameter corresponding to the diameter of the insertion holes 21, on both the top surfaces of the rotation plate 40. Alternatively, slopes may be entirely disposed on the top surfaces of the rotation plate 40 at both sides with respect to a rotation center of the rotation plate 40.

A bushing 52 for improving rotation of the rotation plate 40 may be disposed between the bottom surface of the rotation plate 40 and the lift guide 31 contacting the bottom surface of the rotation plate 40.

Although the insertion holes 21 may be provided in a pair to correspond to a typical 220V outlet in Korea, since the shape of the plug 1 may vary according to countries, the number and shape of the insertion holes 21 may be varied.

Figure 14:
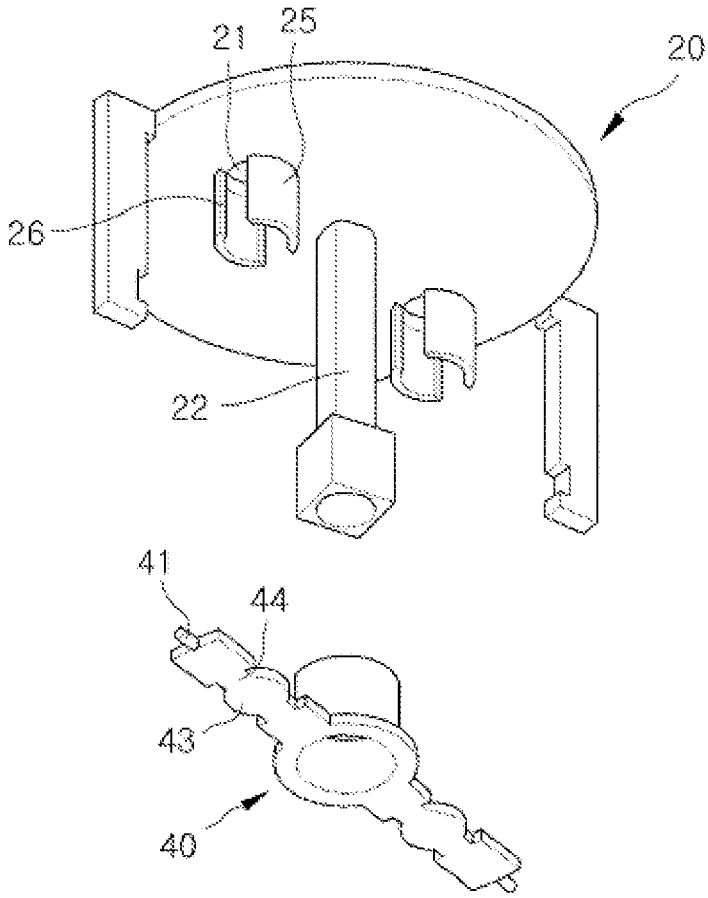
FIG. 14 is an exploded perspective view illustrating a principal part of a safe electrical outlet according to a second embodiment of the present invention.
Figure 15:
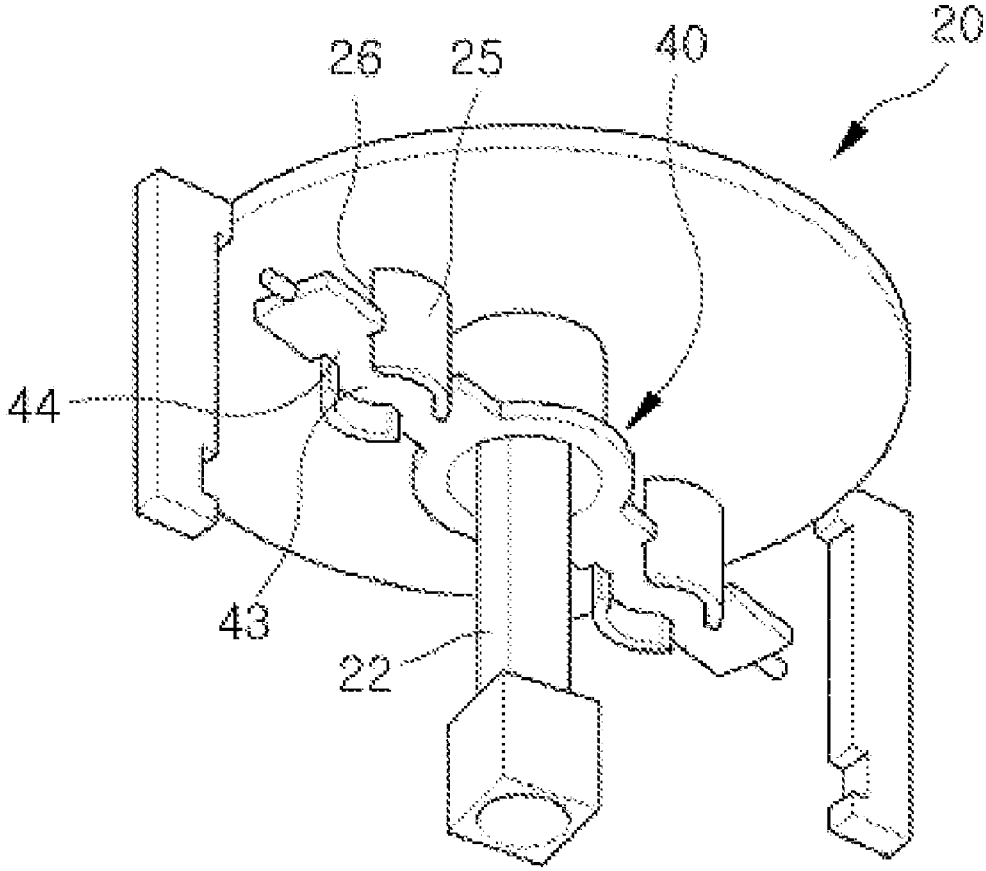
FIG. 15 is a perspective view illustrating the principal part of FIG. 14.

FIG. 14 is an exploded perspective view illustrating a principal part of a safe electrical outlet according to a second embodiment of the present invention. FIG. 15 is a perspective view illustrating the principal part of FIG. 14. The safe electrical outlet according to the current embodiment includes all the components of the first embodiment. Furthermore, insertion hole extension pipes 25 are disposed on the bottom surface of the lift plate 20, and extend downward around the insertion holes 21. Sliding openings 26 vertically extend at both sides of the insertion hole extension pipe 25. The rotation plate 40 includes opening portions 43 having a diameter corresponding to the diameter of the insertion holes 21. Connecting portions 44, which are inserted into the sliding openings 26 and vertically move, are disposed at both sides of the opening portions 43.

The rotation plate 40 may be separated from the lift plate 20 to vertically move and laterally rotate. Accordingly, when the plug 1 is removed from the safe electrical outlet, the rotation plate 40 and the lift plate 20 move upward, and the connecting portions 44 of the rotation plate 40 are inserted into the sliding openings 26. At this point, the opening portions 43 are also inserted into the insertion hole extension pipe 25 to more securely close the insertion holes 21, thereby preventing a foreign substance such as dust from being introduced into the case 10 through the insertion holes 21.

Furthermore, the safe electrical outlet configured as described above may be provided in plurality, and the safe electrical outlets may be integrated to form a power strip.

Figure 16:
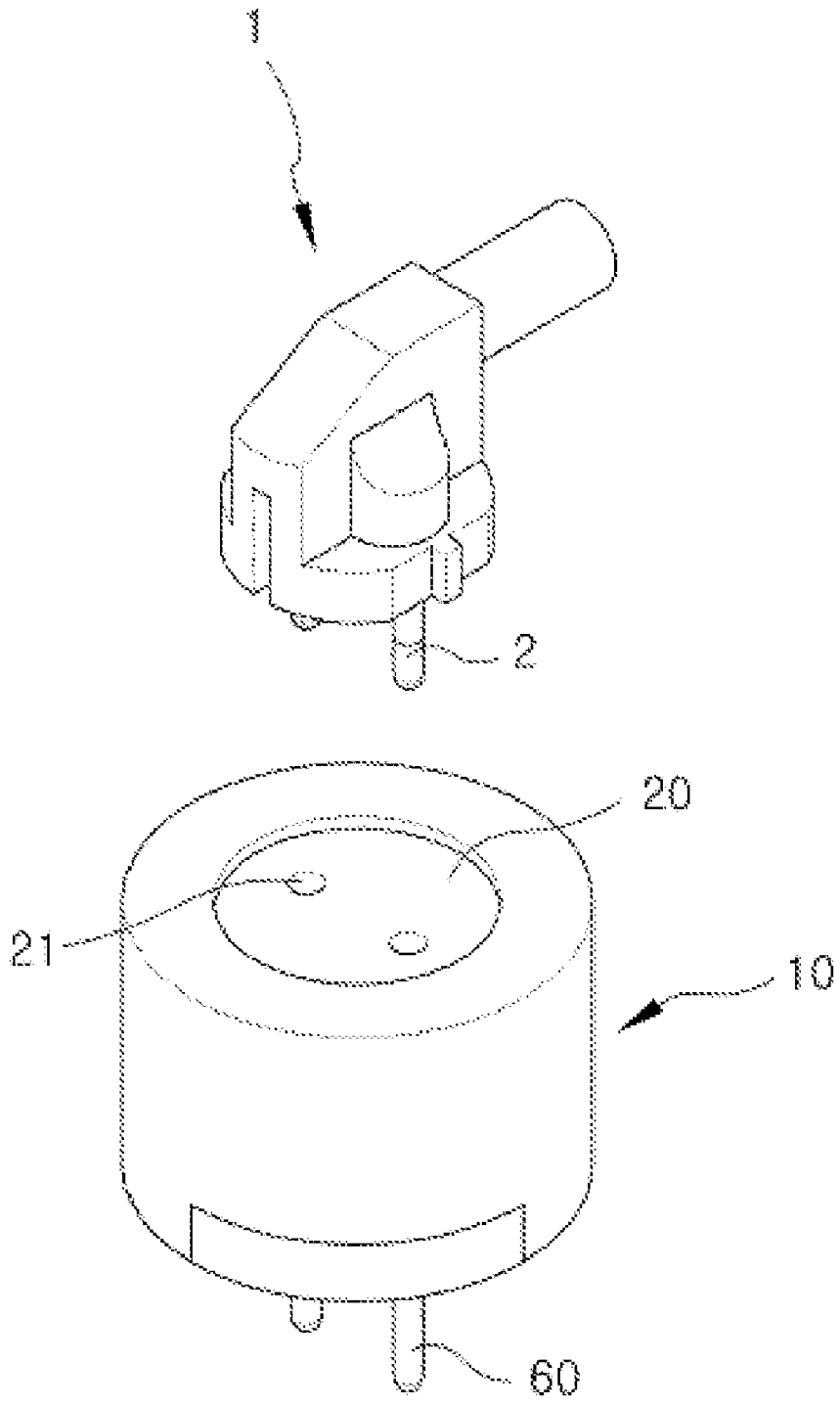
FIG. 16 is a perspective view illustrating a safe electrical outlet according to a third embodiment of the present invention.

FIG. 16 is a perspective view illustrating a safe electrical outlet according to a third embodiment of the present invention. The safe electrical outlet according to the current embodiment includes all the components of the first and second embodiments. Further, auxiliary terminal pins 60 protrude from the bottom of the case 10 to couple to a typical outlet, and are electrically connected to the connecting terminals 11.

The auxiliary terminal pins 60 are the same in shape as the connecting pins 2 of the plug 1 inserted into the insertion holes 21, so that the safe electrical outlet can be conveniently inserted in a typical outlet.

Figure 17:
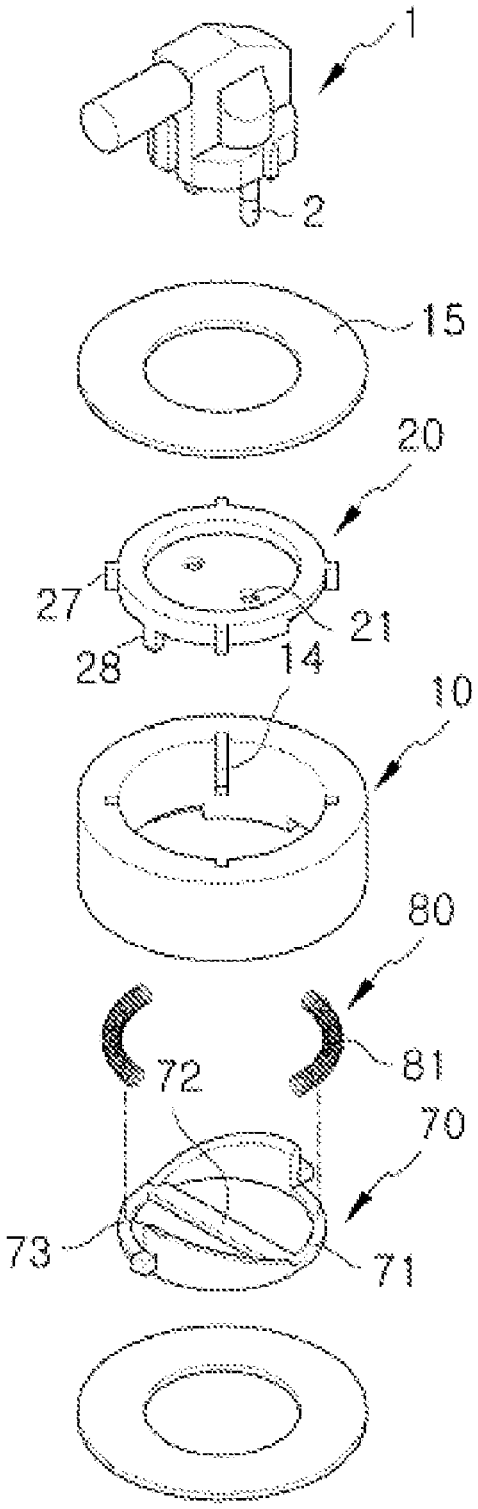
FIGS. 17 and 18 are exploded perspective views illustrating a safe electrical outlet according to a fourth embodiment of the present invention.
Figure 18:
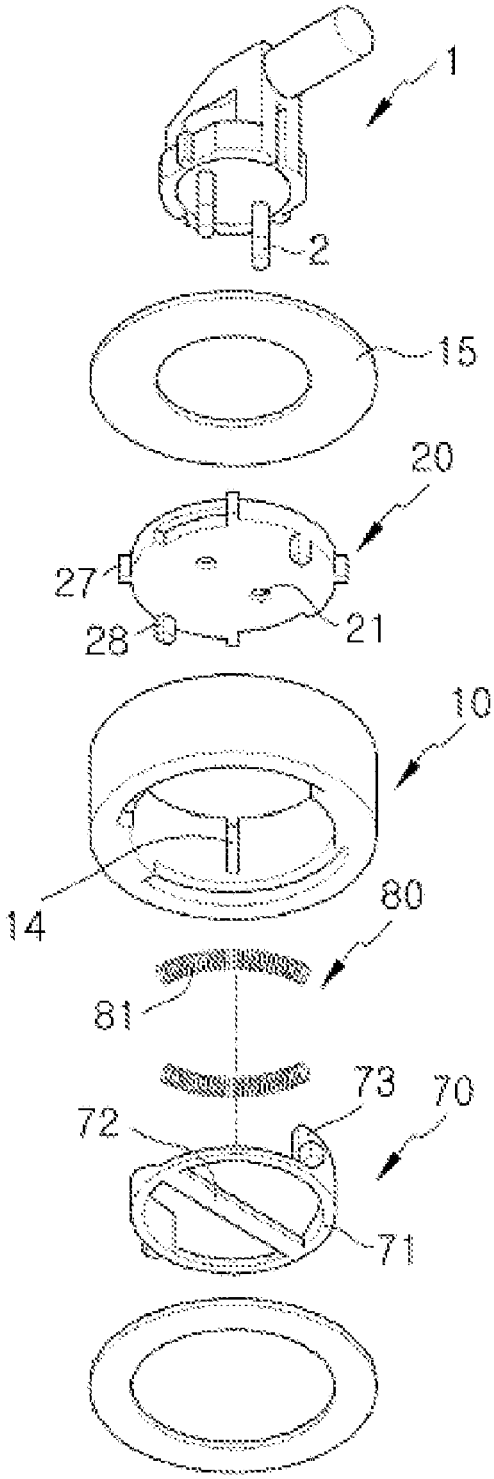
Figure 19:
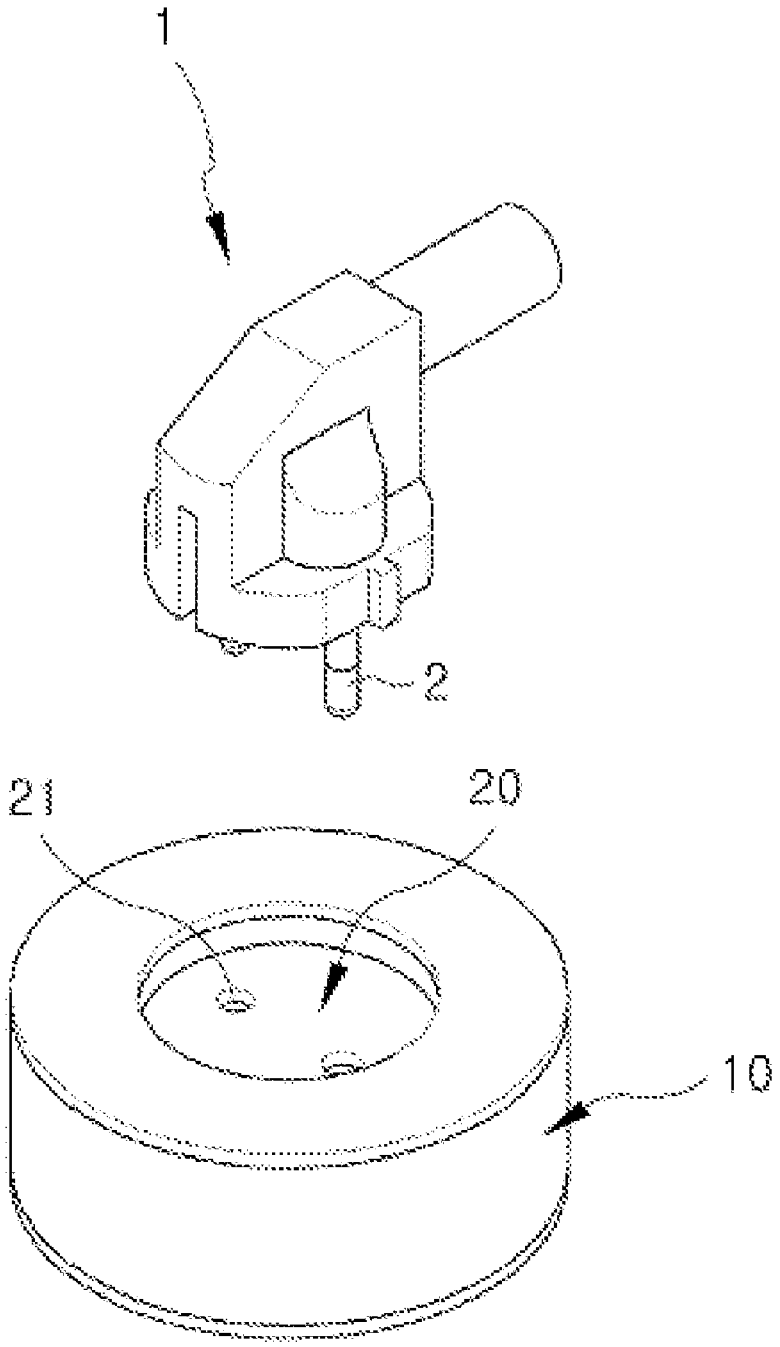
FIG. 19 is a perspective view illustrating the safe electrical outlet of FIGS. 6A and 6B.
Figure 20:
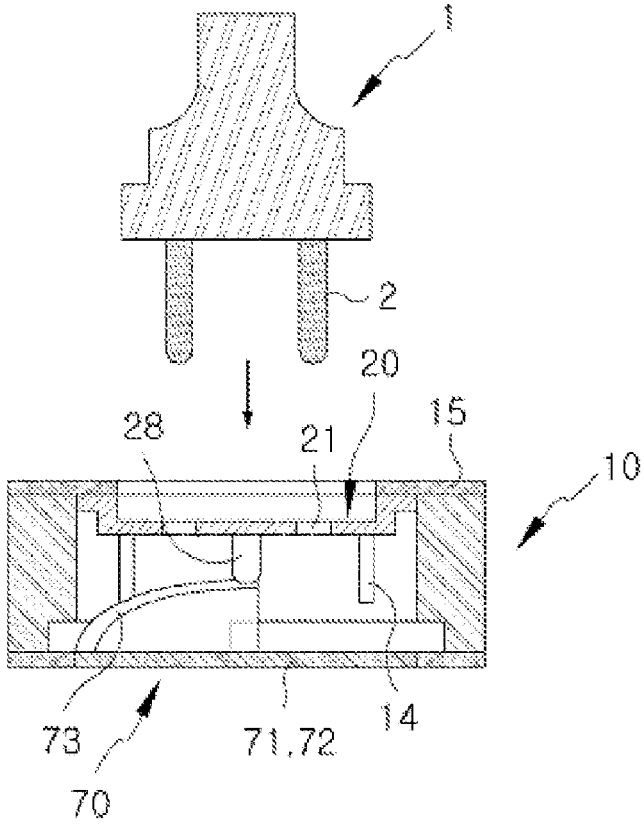
FIGS. 20 to 23 are cross-sectional views illustrating a process in which a plug is coupled to the safe electrical outlet of FIG. 19.
Figure 21:
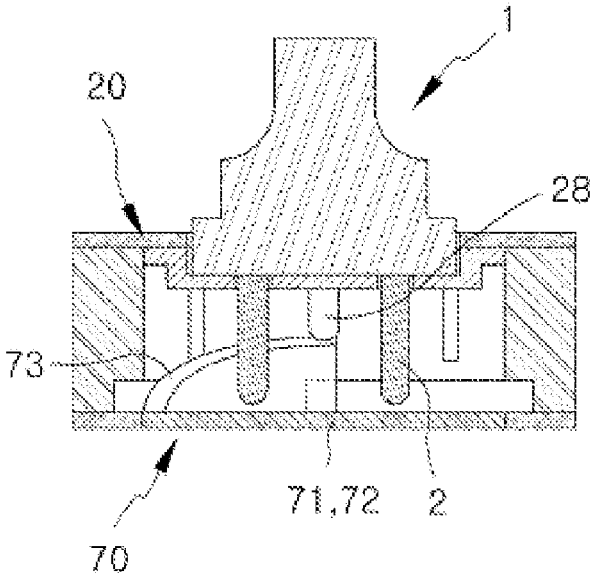
Figure 22:
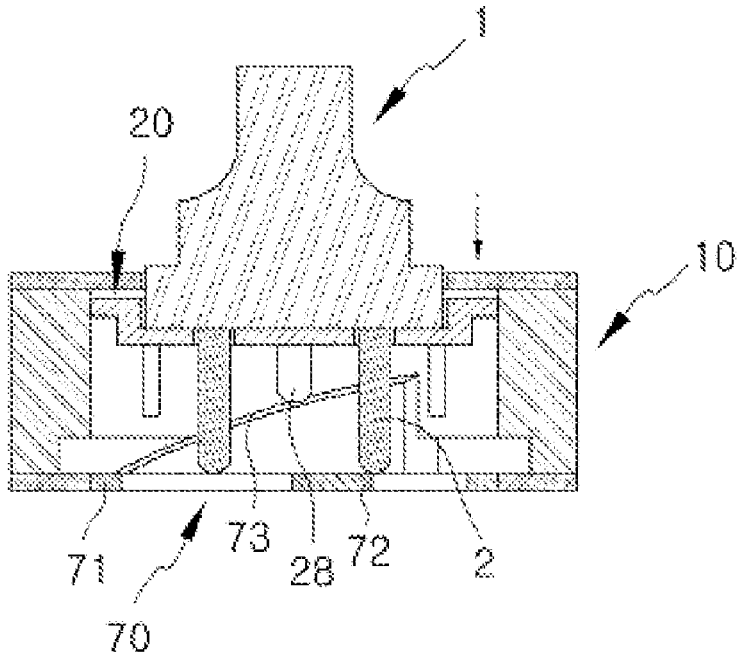
Figure 23:
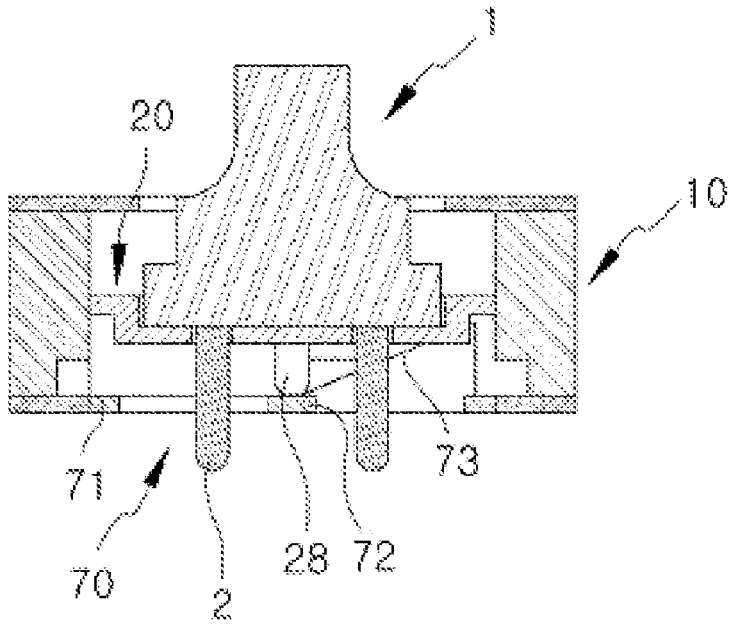

FIGS. 17 and 18 are exploded perspective views illustrating a safe electrical outlet according to a fourth embodiment of the present invention. FIG. 19 is a perspective view illustrating the safe electrical outlet of FIGS. 17 and 18. FIGS. 20 to 23 are cross-sectional views illustrating a process in which the plug 1 is coupled to the safe electrical outlet of FIG. 19.

Referring to FIGS. 17 to 19, the safe electrical outlet has a simple configuration to minimize the height thereof. The safe electrical outlet includes a lift plate 20, an opening and closing member 70, and a lift operation member 80, to prevent introduction of a foreign substance into the safe electrical outlet when the plug 1 is removed from the safe electrical outlet. The lift plate 20, which vertically moves, is coupled to the inner portion of the case 10 having a top opening. The opening and closing member 70, which laterally rotates, is coupled to the lower portion of the lift plate 20 to open and close insertion holes 21 of the lift plate 20. When the plug 1 presses the lift plate 20 downward, the lift operation member 80 rotates the opening and closing member 70 to open the insertion holes 21. When the lift plate 20 moves upward with the plug 1 inserted in the safe electrical outlet, the lift operation member 80 rotates the opening and closing member 70 to close the insertion holes 21.

The case 10 constitutes the outer surface of the safe electrical outlet, and integrates various inner parts. In addition, the case 10 covers the connecting pins 2 of the plug 1, and connecting terminals (not shown) connected to the connecting pins 2. The inner surface of the case 10 forms a cylindrical space having a top opening.

The lift plate 20 is coupled to a top open part of the case 10 to vertically move along the inner surface of the case 10. The lift plate 20 includes the insertion holes 21 that vertically pass therethrough such that the connecting pins 2 are inserted into the case 10 through the insertion holes 21. The lift plate 20 engages with the opening and closing member 70 to be described later. Thus, when the lift plate 20 vertically moves, the opening and closing member 70 rotates to open and close the insertion holes 21.

The opening and closing member 70 is disposed in the case 10, and is coupled to the lower portion of the lift plate 20 such that the opening and closing member 70 laterally rotates to open and close the insertion holes 21. The opening and closing member 70 includes a ring-shaped rotation ring 71 and a closing portion 72. The ring-shaped rotation ring 71 closely contacts the inner surface of the case 10. The closing portion 72 passes through the center of the rotation ring 71, and has both ends fixed to both sides of the rotation ring 71, and closes the lower portions of the insertion holes 21.

When the plug 1 is coupled to the safe electrical outlet to insert the lift plate 20 into the case 10, the lift operation member 80 rotates the opening and closing member 70 and opens the insertion holes 21. When the plug 1 is decoupled from the safe electrical outlet to move the lift plate 20 upward, the lift operation member 80 reversely rotates the opening and closing member 70 and closes the insertion holes 21. The lift operation member 80 includes: one or more guide protrusions 27 protruding from the outer surface of the lift plate 20; guide recesses 14 recessed in the inner surface of the case 10, vertically extending, and receiving the guide protrusions 27; pressing protrusions 28 protruding from the bottom of the lift plate 20; a rotation slope ring 73 protruding from the top surface of the rotation ring 71 and contacting the pressing protrusions 28; and elastic restoring members 81 elastically rotates the opening and closing member 70 to close the insertion holes 21.

The guide protrusions 27 protrude outward from the lift plate 20 to prevent a lateral rotation of the lift plate 20 and allow a vertical movement of the lift plate 20 at a predetermined position. The guide recesses 14 recessed in the inner surface of the case 10 extend a length corresponding to the distance over which the lift plate 20 vertically moves.

The pressing protrusions 28 protrude downward from the bottom edge of the lift plate 20. The rotation slope rings 73 protrude from the top surface of the rotation ring 71 and have slopes. Accordingly, when the lift plate 20 moves downward, the pressing protrusions 28 also moves downward to laterally push the rotation slope ring 73, thereby rotating the rotation ring 71.

The elastic restoring member 81 disposed in the case 10 is constituted by a typical coil spring. An end of the elastic restoring members 81 is supported by the case 10, and the other end thereof is supported by the opening and closing member 70. When the opening and closing member 70 is coupled to the inner portion of the case 10, the opening and closing member 70 is elastically supported to close the insertion holes 21.

Accordingly, referring to FIGS. 20 to 23, when the plug 1 is coupled to the safe electrical outlet, the connecting pins 2 are inserted into the insertion holes 21, and then, the plug 1 is pressed into the case 10. Then, the lift plate 20 is moved downward in the case 10. At this point, the pressing protrusions 28 provided to the bottom of the lift plate 20 laterally push the rotation slope rings 73, and the opening and closing member 70 laterally rotates.

Accordingly, the closing portion 72 rotates to open the insertion holes 21, and spaces between the rotation ring 71 and the closing portion 72 are disposed beneath the insertion holes 21. Thus, the connecting pins 2 move to the lower side of the opening and closing member 70 through the spaces between the rotation ring 71 and the closing portion 72, so that the connecting pins 2 can contact the connecting terminals (not shown) coupled to the inner portion of the case 10.

On the contrary, when the plug 1 is pulled out of the safe electrical outlet, the lift plate 20 is moved upward, and the opening and closing member 70 is reversely rotated by the elasticity of the elastic restoring members 81. When the connecting pins 2 are completely removed from the insertion holes 21, the closing portion 72 rotates to its original position to close the insertion holes 21 again.

Thus, when a foreign material such as a chopstick or a nail is inserted into the insertion holes 21, the closing portion 72 securely closes the insertion holes 21. Only when the plug 1 presses the lift plate 20, the opening and closing member 70 is rotated to open the insertion holes 21, thereby more effectively preventing an electric shock.

A removal prevention ring 15, which has an inner diameter smaller than an outer diameter of the lift plate 20, is coupled to the top surface of the case 10 to prevent a removal of the lift plate 20. Thus, while the lift plate 20 vertically moves, the lift plate 20 is prevented from being removed from the case 10, thereby preventing a malfunction and a trouble of the safe electrical outlet Also in the current embodiment, like the third embodiment, the connecting terminals (not shown) contacting the connecting pins 2 are coupled to the inner portion of the case 10, and auxiliary terminal pins, which are electrically connected to the connecting terminals to attach the safe electrical outlet to a typical outlet, may protrude from the bottom of the case 10.

While the present invention has been described in detail, it should be understood that various changes, substitutions and alterations can be made hereto without departing from the spirit and scope of the invention as defined by the appended claims.

What is claimed is:

1. A safe electrical outlet comprising:

a case having a top opening and an inner lower portion to which a connecting terminal is fixed;

a lift plate coupled to an inner portion of the case and vertically moving and including at least one insertion hole in which a connecting pin of a plug for connecting to a power source is inserted; and a lift operation unit coupled to the inner portion of the case, wherein, when the connecting pin is inserted in the insertion hole to move the lift plate downward in the case, the connecting terminal contacts the connecting pin, and the lift operation unit fixes the lift plate, and when the plug is pressed to a lower side of the case with the connecting terminal contacting the connecting pin, the lift plate is elastically moved upward to space the connecting pin apart from the connecting terminal.

2. The safe electrical outlet of claim 1, wherein the lift operation unit comprises:

a central shaft vertically protruding downward from a central bottom of the lift plate;

a lift guide coupled to the inner portion of the case and receiving a lower end of the central shaft such that the lower end vertically moves;

a first elastic member inserted in the lift guide and elastically supporting the central shaft to an outside of the lift guide;

a catching protrusion protruding into the lift guide;

a pressing protrusion protruding to an opposite side to the catching protrusion and contacting the connecting pin and elastically moving the catching protrusion to the central shaft; and a guide recess part disposed in an outer surface of the central shaft, wherein the guide recess part is caught to the catching protrusion by a downward movement of the central shaft, and is released from the catching protrusion by another downward movement of the central shaft.

3. The safe electrical outlet of claim 2, wherein the guide recess part comprises:

an introduction recess guiding the catching protrusion to move to an upper side of the central shaft while the lift plate is moved downward by force pressing the plug;

a first upper stopper limiting a relative upward movement of the catching protrusion;

a lower stopper limiting a downward moving distance of the catching protrusion when the force pressing the plug is removed with the catching protrusion supported by the first upper stopper, and when the catching protrusion is relatively moved downward by the first elastic member;

a second upper stopper limiting an upward moving distance of the catching protrusion when the catching protrusion is moved upward by force pressing the plug with the catching protrusion supported by the lower stopper; and a removal recess guiding the catching protrusion to be removed downward when the force pressing the plug is removed with the catching protrusion supported by the second upper stopper, and when the catching protrusion is relatively moved downward by the first elastic member.

4. The safe electrical outlet of claim 1, further comprising:

a rotation plate that is rotatably coupled to a lower portion of the lift plate to open and close the insertion hole; and a rotation plate operating part that rotates the rotation plate to open the insertion hole when the lift plate moves downward, and rotates the rotation plate to close the insertion hole when the lift plate moves upward.

5. The safe electrical outlet of claim 4, wherein the rotation plate operating part comprises:

guide protrusions protruding from both ends of the rotation plate;

first guide recesses recessed from an inner surface of the case and extending in a vertical moving direction of the lift plate;

second guide recesses laterally inclined from a lower portion of the first guide recesses; and a second elastic member coupled to a lower portion of the rotation plate and elastically supporting the rotation plate.

6. The safe electrical outlet of claim 5, further comprising:

vertical moving guides that protrude downward from both sides of the lift plate, closely contact the inner surface of the case, vertically move, and prevent a lateral rotation of the guide protrusion; and opening recesses that are disposed in inner surfaces of the vertical moving guides, and allow the guide protrusion to pass through the second guide recess to laterally rotate the rotation plate when the lift plate moves downward.

7. The safe electrical outlet of claim 6, wherein a slope protrusion protrudes from a top surface of the rotation plate and is inclined in a rotation direction of the rotation plate.

8. The safe electrical outlet of claim 5, wherein an insertion hole extension pipe protrudes downward from a bottom surface of the lift plate to form an extension of the insertion hole, sliding openings are disposed at both sides of the insertion hole extension pipe, an opening portion having a diameter corresponding to that of the insertion hole is disposed in the rotation plate, and connecting portions that are inserted in the sliding openings and vertically move are disposed at both sides of the opening portion.

9. The safe electrical outlet of any one of claims 1, further comprising an auxiliary terminal pin that protrudes from a bottom surface of the case, is inserted in a typical outlet, and is connected to the connecting terminal.

10. A safe electrical outlet comprising:

a case having a top opening and an inner lower portion to which a connecting terminal is fixed;

a lift plate coupled to an inner portion of the case and vertically moving and including at least one insertion hole in which a connecting pin of a plug for connecting to a power source is inserted;

an opening and closing member rotatably coupled to a lower portion of the lift plate and opening and closing the insertion hole; and a lift operation member, wherein, when the plug presses the lift plate downward, the lift operation member rotates the opening and closing member to open the insertion hole, and when the plug moves to an upper side of the lift plate to move the lift plate upward, the lift operation member rotates the opening and closing member to close the insertion hole.

11. The safe electrical outlet of claim 10, wherein the opening and closing member comprises:

a ring-shaped rotation ring rotatably coupled to an inner surface of the case and having a vertical through hole in a center thereof; and a closing portion passing through the center of the rotation ring, having both ends fixed to both sides of the rotation ring, and closing the insertion hole.

12. The safe electrical outlet of claim 11, wherein the lift operation member comprises:

a guide protrusion protruding from an outer surface of the lift plate;

a guide recess recessed in the inner surface of the case, vertically extending, and receiving the guide protrusion;

a pressing protrusion protruding from a bottom edge of the lift plate;

a rotation slope ring protruding from a top surface of the rotation ring, contacting the pressing protrusion, and having a top slope to rotate the rotation ring according to a vertical movement of the pressing protrusion; and an elastic restoring member elastically rotating the opening and closing member to a closing position.

13. The safe electrical outlet of any one of claims 10, further comprising:

a connecting terminal that is disposed on an inner bottom of the case and contacts the connecting pin; and an auxiliary terminal pin that protrudes from a bottom surface of the case, is inserted in a typical outlet, and is connected to the connecting terminal.

* * * * *